US009334644B2

(12) United States Patent
Harnois et al.

(10) Patent No.: US 9,334,644 B2
(45) Date of Patent: May 10, 2016

(54) RETAINING MEMBRANE ON A STRUCTURE

(71) Applicant: LES INDUSTRIES HARNOIS Inc., Saint-Thomas (CA)

(72) Inventors: Patrice Harnois, Ste-Elisabeth (CA); Marc Coutu, St-Thomas (CA); Mario Savignac, Saint-Thomas (CA)

( * ) Notice: Subject to any disclaimer, the term of this patent is extended or adjusted under 35 U.S.C. 154(b) by 0 days.

(21) Appl. No.: 14/429,177

(22) PCT Filed: Sep. 19, 2012

(86) PCT No.: PCT/CA2012/000862
§ 371 (c)(1),
(2) Date: Mar. 18, 2015

(87) PCT Pub. No.: WO2014/043779
PCT Pub. Date: Mar. 27, 2014

(65) Prior Publication Data

US 2015/0233107 A1 Aug. 20, 2015

(51) Int. Cl.

| | |
|---|---|
| ***E04B 1/343*** | (2006.01) |
| ***E04F 13/26*** | (2006.01) |
| ***E04B 1/41*** | (2006.01) |
| ***E04F 13/00*** | (2006.01) |

(Continued)

(52) U.S. Cl.
CPC ..... *E04B 1/34321* (2013.01); *E04B 1/24* (2013.01); *E04B 1/342* (2013.01); *E04B 1/34384* (2013.01); *E04B 1/40* (2013.01); *E04F 13/005* (2013.01); *E04F 13/26* (2013.01); *E04B 2001/2466* (2013.01); *E04B 2001/2481* (2013.01); *E04B 2103/06* (2013.01)

(58) Field of Classification Search
CPC ..... E04B 1/34321; E04B 1/40; E04B 1/342; E04B 1/24; E04B 1/34384; E04B 2001/2466; E04B 2001/2481; E04F 13/26; E04F 13/005
USPC ..... 52/63, 222, 745.06
See application file for complete search history.

(56) References Cited

U.S. PATENT DOCUMENTS 3,240,217 A * 3/1966 Bird ..... E04H 15/22 135/119
3,909,994 A * 10/1975 Richter ..... E04B 1/3211 135/119
4,118,904 A * 10/1978 Sprung ..... E04H 15/18 135/119

(Continued)

FOREIGN PATENT DOCUMENTS

KR 101076264 10/2011

*Primary Examiner* — Brent W Herring
(74) *Attorney, Agent, or Firm* — Larson & Larson, P.A.; Justin P. Miller; Patrick A. Reid

(57) ABSTRACT

Method for installation and replacement of a membrane and system for retaining membrane on a structure. A connecting member comprises at least one radial channel for receiving a first guiding strip of a membrane sheet further having a second guiding strip. A fastening mechanism is provided for adjusting tension in the sheet by controlling depth at which the connecting member is maintained within a top channel on a truss of the structure. The tension may be adjusted by applying torque to bolted screws maintaining the connecting member into the top channel. Replacing the membrane sheet under tension involves unfastening, at least partially, the connecting member from the top channel to remove tension in the sheet and removing the sheet to be replaced from the connecting member and a second connecting member maintained on another truss.

27 Claims, 9 Drawing Sheets

(51) Int. Cl.
*E04B 1/24* (2006.01)
*E04B 1/342* (2006.01)

(56) References Cited

U.S. PATENT DOCUMENTS 4,137,687 A * 2/1979 Sprung ..... E04H 15/32 52/222
4,817,655 A * 4/1989 Brooks ..... E04H 15/58 135/119
4,865,066 A * 9/1989 Brooks ..... E04H 15/58 135/121
5,333,425 A * 8/1994 Nickerson ..... E04H 15/18 160/383
5,823,704 A * 10/1998 Koch ..... E04H 15/642 403/391
6,564,513 B2 * 5/2003 Henbid ..... E04H 15/644 160/394
8,056,602 B1 * 11/2011 Green ..... E06B 9/52 160/392
8,984,843 B2 * 3/2015 Tak ..... E04C 3/02 52/222
2010/0037544 A1 2/2010 Musgrave et al.
2014/0230363 A1 * 8/2014 Tak ..... E04C 3/02 52/831

* cited by examiner

RETAINING MEMBRANE ON A STRUCTURE

PRIORITY

This application is a continuation of International Application No. PCT/CA2012/000862, filed Sep. 19, 2012.

TECHNICAL FIELD

The present invention relates to membrane covered structures and, more specifically, structures covered by interconnected sections of membrane.

BACKGROUND

Membrane covered structures are usually large metal structures covered by flexible material placed thereover. These membrane covered structures usually serve as a shelter for human activities or for storing quantities of crops, engines, other utilities, etc. The nature of the flexible material makes it more prone to wear and tear over time. Installing or repairing the membrane of a membrane covered building is cumbersome as it sometimes requires affecting the structure itself in order to install a new section of membrane or replacing a section of membrane.

The present invention addresses the above issue.

SUMMARY

A first aspect of the present invention is directed to a system for retaining membrane on a structure. The system comprises a connecting member, a truss of the structure and fastening mechanism. The connecting member comprises at least one radial channel for receiving a first guiding strip of a first membrane sheet having the first guiding strip and a second guiding strip. The fastening mechanism is for adjusting tension in the first sheet by controlling depth at which a connecting member is maintained within a top channel on the truss.

The first guiding strip of the first sheet may be located on a lateral portion of the first sheet. The second guiding strip of the first sheet may be located on an opposite lateral portion of the first sheet. The guiding strips may be flexible.

The top channel may be formed by an upper surface of the truss or may be maintained over the upper surface of the truss (i.e., an additional member forms the top channel and is maintained over the truss by the fastening mechanism or by other means).

The first sheet may be made of fabric.

The connecting member may be formed by multiple sub-connecting members within the top channel of the truss.

The connecting member may comprise a second radial channel. A first guiding strip of a second sheet of membrane may be inserted in the second radial channel.

The connecting member may be extruded. The connecting member may be made of aluminum, an aluminum alloy or a polymer. The connecting member may comprise a bottom channel and the fastening mechanism may comprise screws and nuts. The bottom channel may be adapted to receive screw heads. The screws may be bolted into the top channel of the truss.

The tension may be adjusted by applying a torque to the bolted screws maintaining the connecting member into the top channel.

The truss may be made of steel, which may further be galvanized steel.

A second aspect of the present invention is directed to a method for installation of membrane sheets over a structure.

The method comprises inserting a first guiding strip located on a lateral portion of a first membrane sheet into a first radial channel of a first connecting member. The method further comprises inserting a first guiding strip located on a lateral portion of a second membrane sheet into a second radial channel of the first connecting member. The method further comprises inserting the first connecting member into a first top channel of a first truss of the structure for receiving the first connecting member and fastening the first connecting member in the first top channel of the first truss. The tension applied in the first sheet is related to a first depth at which the first connecting member is maintained in the first top channel of the first truss.

The method for installation of membrane sheets over a structure may further comprise inserting a second guiding strip located on an opposite lateral portion of the first membrane sheet into a first radial channel of a second connecting member. The method may further comprise inserting the second connecting member into a second top channel of a second truss of the structure for receiving the second connecting member. The method may further comprise fastening the second connecting member in the second top channel of the second truss. The tension applied in the first sheet is related to both the first depth at which the first connecting member is maintained in the first top channel of the first truss and a second depth at which the second connecting member is maintained in the second top channel of the second truss.

The method for installation of membrane sheets over a structure may further comprise fastening the first connecting member to the first top channel of the first truss by bolting screws. The screw heads of the screws may be received in a first bottom channel of the first connecting member. The screws may then be bolted into the first top channel of the first truss.

The method for installation of membrane sheets over a structure may further comprise fastening the second connecting member to the second top channel of the second truss by bolting screws. Screw heads of the screws may be received in a second bottom channel of the second connecting member. The screws may then be bolted into the second top channel of the second truss.

A third aspect of the present invention is directed to a method for replacing a membrane sheet on a membrane covered structure. The membrane sheet to be replaced is under tension and inserted into a first connecting member fastened in a first top channel of a first truss and a second connecting member fastened in a second top channel of a second truss. The method comprises unfastening, at least partially, the first connecting member from the first top channel of the first truss. The membrane sheet to be replaced has a first guiding strip, located on a lateral portion of the first sheet, the first guiding strip inserted into a first radial channel of the first connecting member. The method further comprises removing the first guiding strip of the sheet to be replaced from the first radial channel of the first connecting member. The method further comprises removing a second guiding strip, located on an opposite lateral portion of the membrane sheet to be replaced, from a first radial channel of the second connecting member.

The method for replacing a membrane sheet to be replaced on a membrane covered structure, where the unfastening may further comprise unbolting screws which are bolted into the first truss. Screw heads of the screws may be received in a first bottom channel of the first connecting member.

The method for replacing a membrane sheet to be replaced on a membrane covered structure may further comprise unfastening the second connecting member from the second top channel of the second truss.

The method for replacing a membrane sheet to be replaced on a membrane covered structure, where the unfastening may further comprise unbolting screws which are bolted into the second truss. Screw heads of the screws may be received in a second bottom channel of the second connecting member.

The method for replacing a membrane sheet to be replaced on a membrane covered structure may further comprise inserting a first guiding strip located on a lateral portion of a replacing membrane sheet into the first radial channel of the first connecting member. The method may further comprise inserting a second guiding strip located on an opposite lateral portion of the replacing membrane sheet into the first radial channel of the second connecting member. The method may further comprise fastening the first connecting member in the first top channel of the first truss. A second tension applied in the replacing sheet may be related to a depth at which the first connecting member is maintained in the first top channel of the first truss.

The method for replacing a membrane sheet to be replaced on a membrane covered structure may further comprise fastening the second connecting member in the second top channel of the second truss. The second tension applied in the replacing sheet may be related to the depth at which the first connecting member is maintained in the first top channel of the first truss and a depth at which the second connecting member is maintained in the second top channel of the second truss.

BRIEF DESCRIPTION OF THE DRAWINGS

Further features and exemplary advantages of the present invention will become apparent from the following detailed description, taken in conjunction with the appended drawings, in which.

DETAILED DESCRIPTION

The present invention provides the exemplary advantage related to the installation and replacement of sections of flexible material of a membrane covered building. The invention may relate to installing or replacing sections of an inner membrane, an outer membrane, or inner and outer membranes of the membrane covered building. Membrane covered structures are used in very diverse contexts. The actual use of the membrane covered structure is not relevant to the teachings of the present invention. By way of non-limiting examples, the membrane covered structure may be used as a storage facility (e.g., for crops, mining, raw materials, engines or other equipments or utilities, etc.), or as a shelter for humans or other animals.

Figure 1:
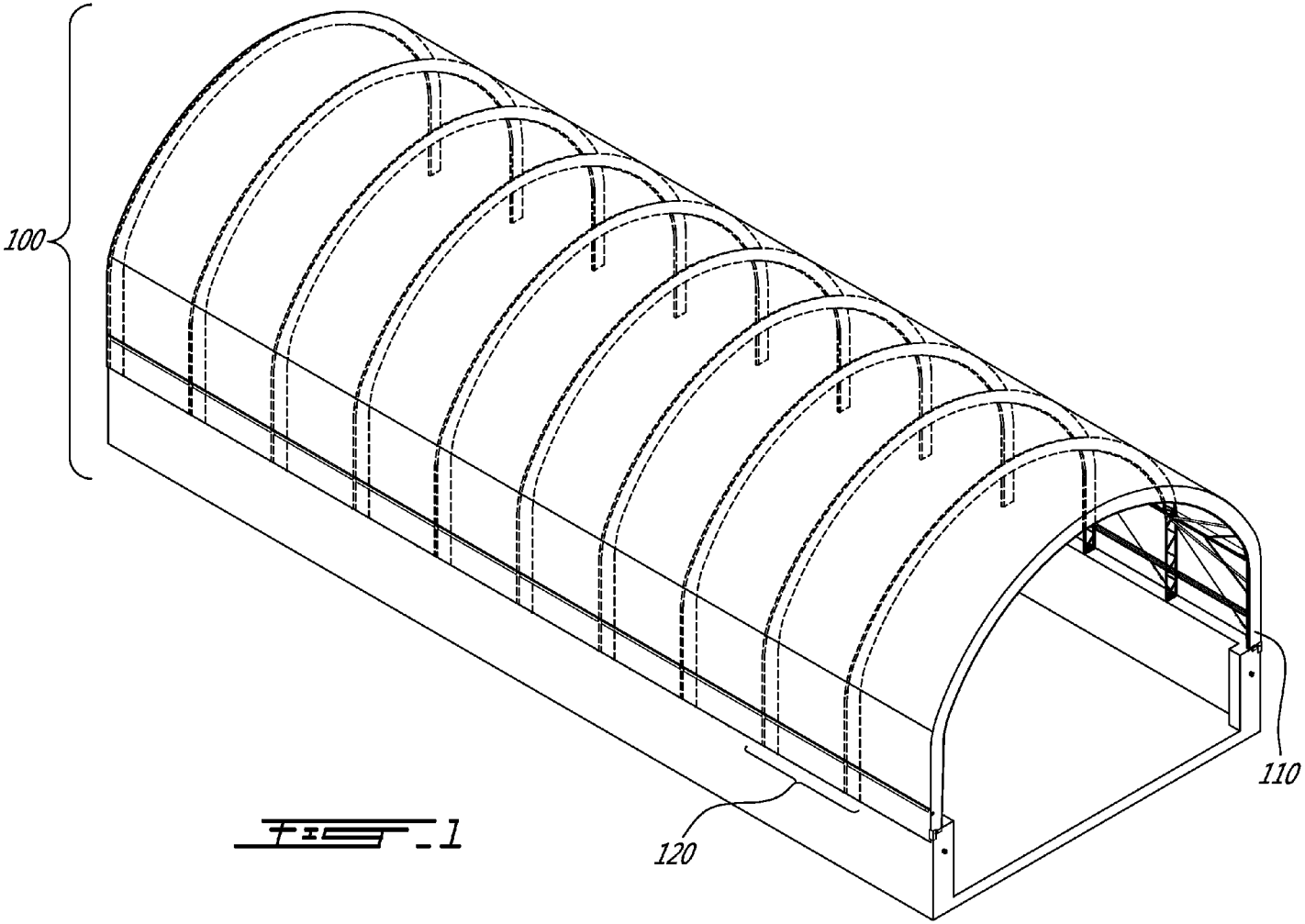
FIG. 1 is a perspective view of an exemplary membrane covered structure in accordance with the teachings of the present invention.

Reference is now made to FIG. 1 of the drawings. FIG. 1 shows a perspective view of an exemplary membrane covered structure 100. The exemplary embodiment of the membrane covered structure comprises multiple trusses 110 forming a structure covered by sheets of membrane 120. In the example of FIG. 1, each of the trusses 110 form part of a system for retaining membrane on a structure 200 (as shown in FIG. 2). Persons skilled in the art will readily recognize that the shape of the membrane covered structure may vary without affecting the invention (e.g. the structure may be round, cylindrical, have a slanting or pitch roof, etc.). likewise, skilled readers will recognize that some or all sheets of membrane 120 could span over one or more of the trusses 110 without affecting the invention. Furthermore, persons skilled in the art will readily recognize that the membrane may cover only portions of the structure, which may further comprise one or more solid surfaces, such as a wall or solid roof section, without affecting the invention.

Figure 2A:
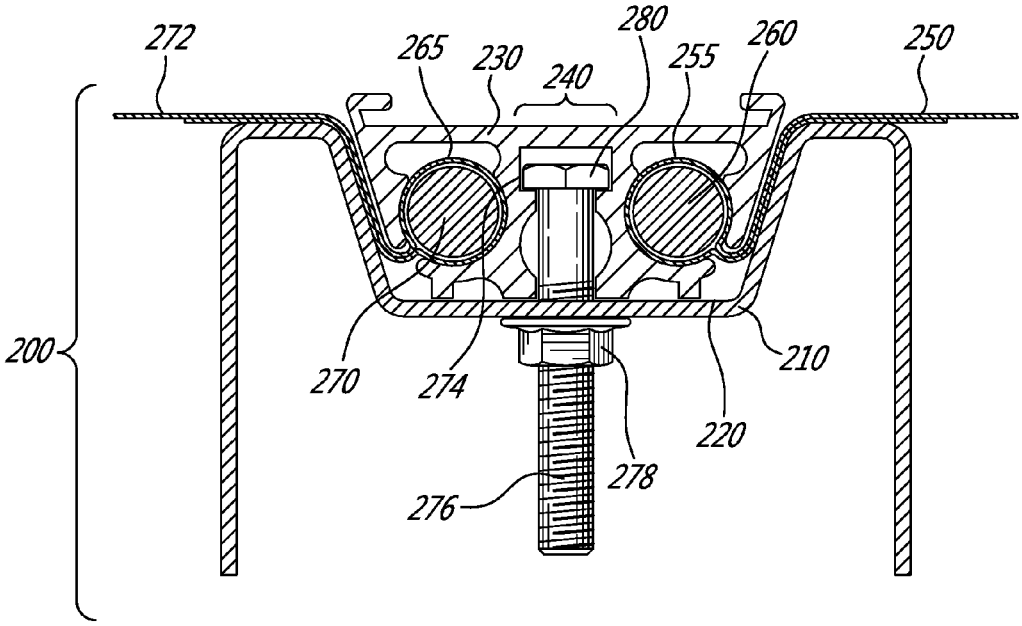
FIG. 2A, FIG. 2B and FIG. 2C herein referred to concurrently as FIG. 2 are views from above of a cross-section of an exemplary system for retaining membrane on a structure in accordance with the teachings of the present invention.
Figure 2B:
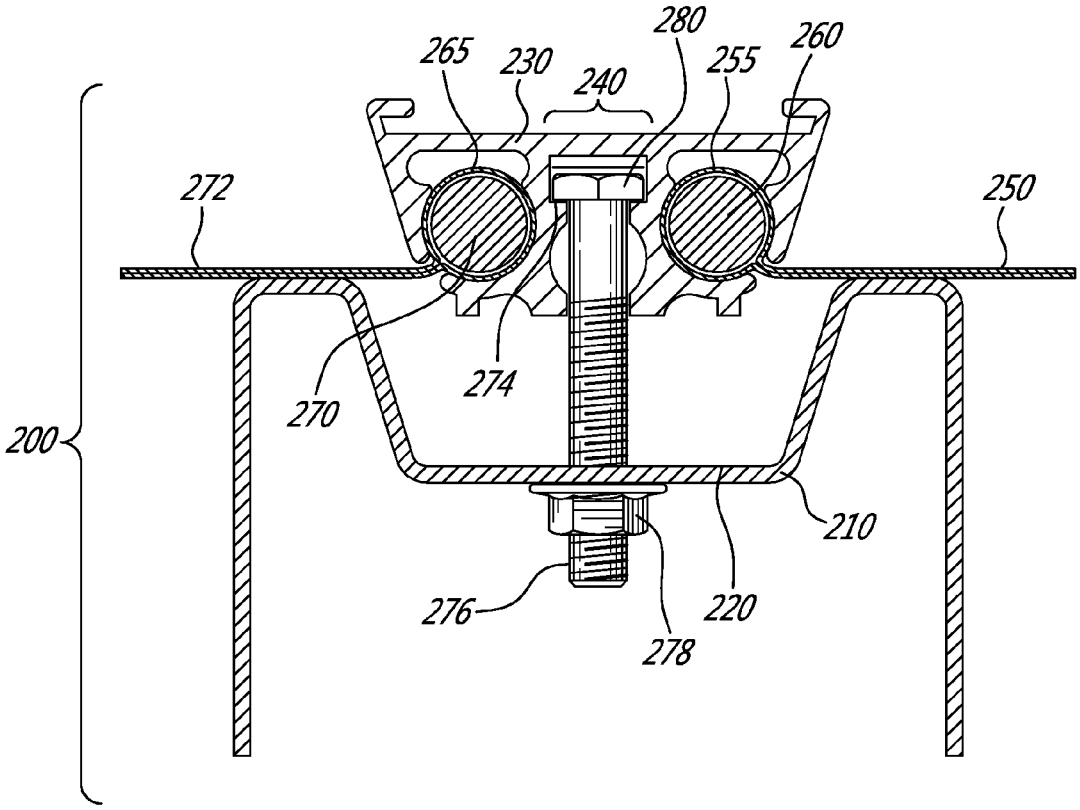

FIG. 2 shows an exemplary cross-section from above of the membrane covered structure 100 showing a system for retaining membrane on a structure 200. In FIG. 2A, sheets of membrane 250 and 272 are under desired tension for an assembled structure. In FIG. 2B, the sheets of membrane 250 and 272 are not under desired tension for an assembled structure. The system for retaining membrane over the structure comprises a truss 210 of the structure 100. The system for retaining membrane over the structure further comprises a fastening mechanism 240 comprising a channel 220 for receiving a connecting member 230. In the example of FIG. 2, the channel 220 is provided with the truss 210. The fastening mechanism 240 is for maintaining the connecting member 230 within the channel 220. In an exemplary embodiment of the system for retaining membrane on a structure 200, the connecting member 230 comprises multiple sub-connecting members (not shown) within the channel 220 of the truss 210. The first sheet of membrane 250 may have a first guiding strip 260 and a second guiding strip (shown in FIG. 4). In the example of FIG. 2, the first guiding strip 260 is inserted in a radial channel 255 of the connecting member 230. The fastening mechanism 240 allows adjusting depth at which the connecting member 230 is maintained in the channel 220. Tension in the first sheet 250 is thereby adjusted through the fastening mechanism 240. In the example shown in FIG. 2B, the connecting member 230 is maintained at the bottom of the channel 220. Skilled readers will understand that, in order to obtain the desired tension in the sheets 250 (and 272), the connecting member 230 may be maintained in the channel 220 without being in direct contact with the channel 220 or any other portion of the truss 210.

Figure 2C:
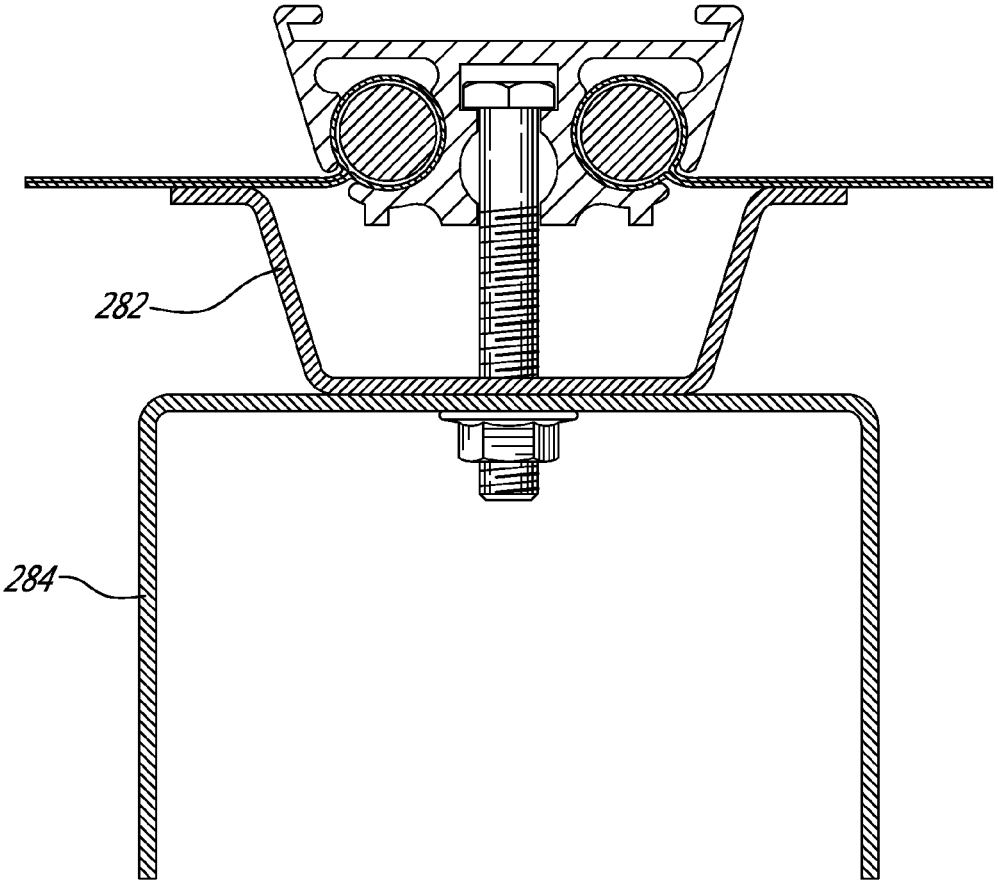

FIG. 2C shows another exemplary embodiment of the system for retaining membrane on the structure 200. In the example shown on FIG. 2C, the channel 220 is formed by an additional member 282. This additional member may be maintained onto a truss 284 using the fastening mechanism 240 as shown or other means (e.g., soldered therewith or otherwise configured to snap and hold thereon).

In the exemplary embodiment of the system for retaining membrane on the structure 200 of FIG. 2, the first guiding strip 250 is located on a lateral portion 260 of the first sheet 250. The second guiding strip (shown in FIG. 4) is located on an opposite lateral portion of the first membrane sheet (shown in FIG. 4).

Sealing techniques could be used in order to prevent seepage through the fabric sheet 250 or between the fabric sheet(s) and connecting member(s). A lubricant may also be used to facilitate the insertion of guiding strips into radial channels and reduce wear over time and/or on sections of the membrane sheets 250 and 272 that are expected to be in contact with the channel 220. For example, these lubricants may be a tape, a liquid or a powder.

In one example of a system for retaining membrane on a structure 200, the first sheet 250, or any other sheet on the membrane covered building, is made of fabric. A person ordinarily skilled in the art will readily recognize that the first sheet 250 or the other sheets of the membrane covered building may be made of another flexible material without affecting the invention.

In the exemplary embodiment of the system for retaining membrane on a structure 200 of FIG. 2, the connecting member 220 comprises a second radial channel 265. A first guiding strip 270 of the second sheet of membrane 272 is inserted in the second radial channel 265.

In the exemplary embodiment of the system for retaining membrane on a structure 200 of FIG. 2, the connecting member 230 comprises a bottom channel 272. The fastening mechanism 240 comprises screws 276 and nuts 278. Heads of the screws 280 are adapted to be received in the bottom channel 274 of the connecting member 230. The screws 276 are bolted into the channel 220 trough the truss 210. Persons skilled in the art will readily recognize that the screws may be substituted by bolts (not shown) or other mechanism for fastening the connecting member 230 to the truss 210, such as a spring system, without affecting the invention. Another example of a mechanism for fastening the connecting member 230 to the truss 210 is a bolt shaped as a T which locks into place after inserting into the truss 210 and when rotated 90 degrees. Screws could also be first inserted into the truss and bolted into the connecting member (not shown).

In the exemplary embodiment of the system for retaining membrane on the structure 200 of FIG. 2, tension can be adjusted by applying torque to the bolted screws 276 maintaining the connecting member 230 into the channel 220 of the truss 210.

In the exemplary embodiment of the system of FIG. 2, the first guiding strip 260 and the second guiding strip 270 are both flexible and made of a polymer. Persons ordinarily skilled in the art will readily recognize that the guiding strips 260 and 270 could be composed of other flexible material aside from a polymer without affecting the invention. Guiding strips may further be replaced by other mechanisms for joining a membrane sheet to a connecting member, such as a snapping mechanism (not shown), without affecting the invention.

The connecting member 230 may be made of aluminum, an aluminum alloy, a polymer, or a mixture of both aluminum and a polymer. Skilled readers will also recognize that the connecting member 230 could be composed of other material without affecting the invention. The connecting member 230 is expected to be extruded, but other methods of fabrication of the connecting member would not affect the teachings of the present invention.

The truss 210 may be made of steel or galvanized steel or a mixture of both steel and galvanized steel. Other material aside from steel or galvanized steel, such as wood or aluminum, could be used without affecting the invention.

Figure 3:
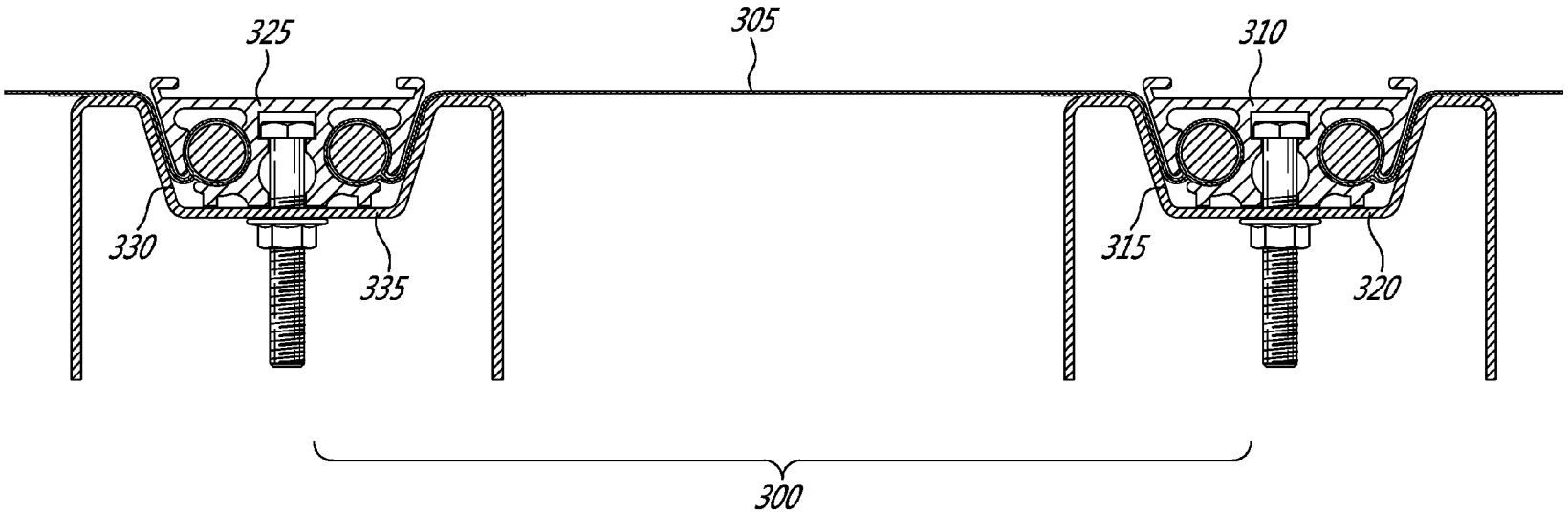
FIG. 3 is a view from above of a cross-section of an exemplary system for retaining membrane on a structure in accordance with the teachings of the present invention.

FIG. 3 shows an exemplary embodiment 300 where a membrane sheet 405 is under tension after installation. Tension applied is related to both a first depth at which a first connecting member 310 is maintained, after being inserted, in a first top channel 315 of a first truss 320 and a second depth at which a second connecting member 325 is maintained, after being inserted, in a second top channel 330 of a second truss 335.

Figure 4:
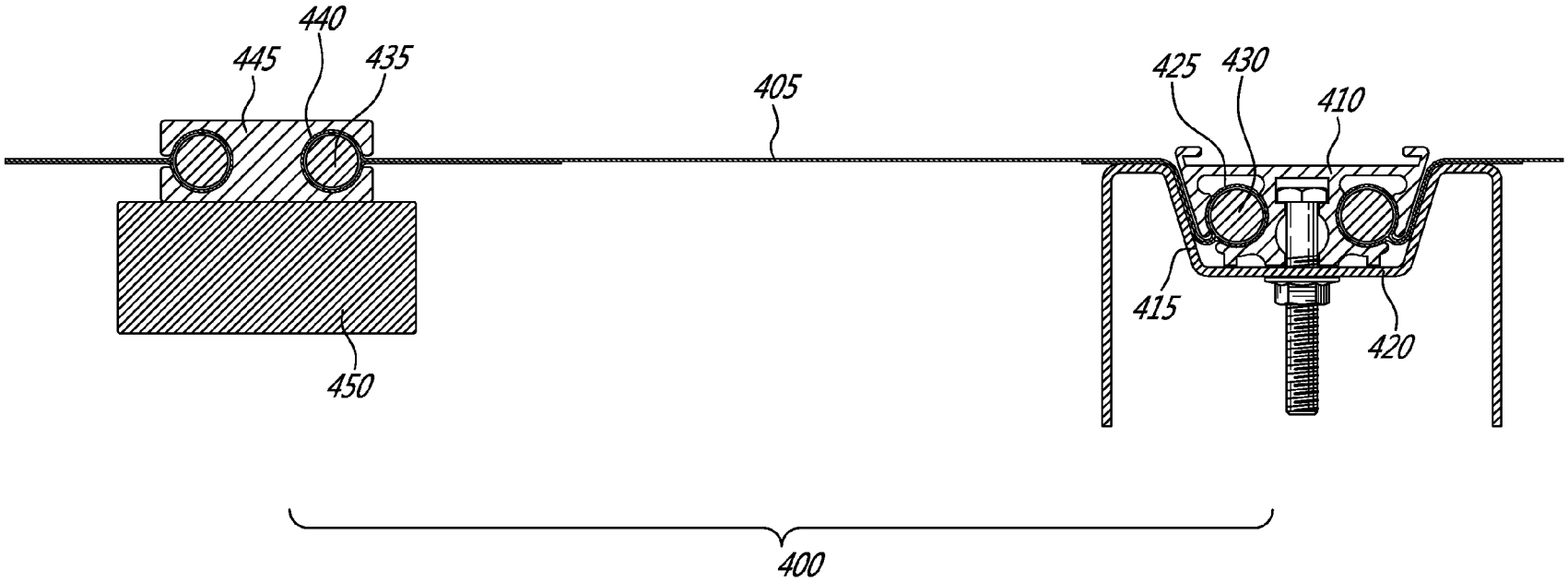
FIG. 4 is a view from above of a cross-section of an exemplary system for retaining membrane on a structure in accordance with the teachings of the present invention.

FIG. 4 shows an exemplary embodiment where a membrane sheet 405 is under tension after installation. The tension is related to a depth at which a first connecting member 410 is maintained, after being inserted, in a first top channel 415 of a first truss 420. A first guiding strip 425 is inserted in a first radial channel 430 of the first connecting member 410. A second guiding strip 435 is inserted into a first radial channel 440 of a second connecting member 445 connected to a second truss 450. In the exemplary embodiment 400, the second truss 450 does not have a channel for maintaining the second connecting member 445.

Figure 5:
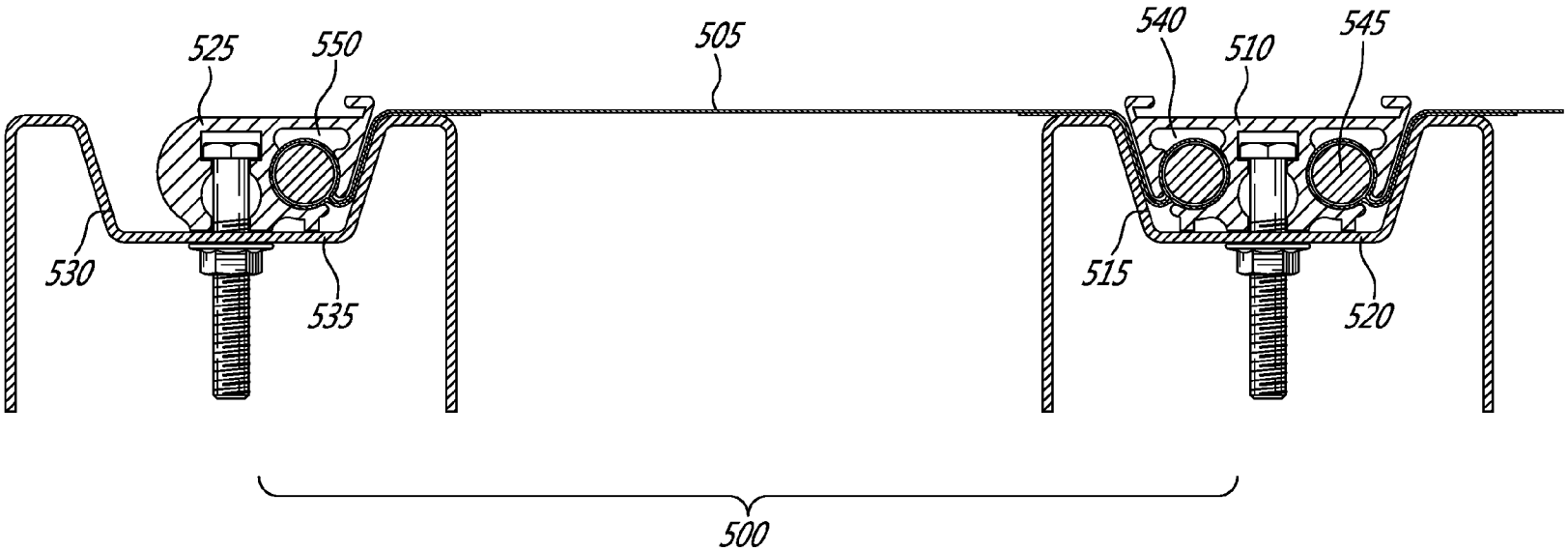
FIG. 5 is a view from above of a cross-section of an exemplary system for retaining membrane on a structure in accordance with the teachings of the present invention.

FIG. 5 shows an exemplary embodiment 500 where a membrane sheet 505 is under tension after installation. The tension applied is related to both a first depth at which a first connecting member 510 is maintained, after being inserted, in a first top channel 515 of a first truss 520 and a second depth at which a second connecting member 525 is maintained, after being inserted, in a second top channel 530 of a second truss 535. In the exemplary embodiment 500, the first connecting member 525 comprises two radial channels 540 and 545 and the second connecting member comprises one radial channel 550.

As an additional option, the membrane sheets 305, 405 or 505 could span over an additional truss (not shown) between the shown trusses even though this additional truss is not comprised in a system for controlling tension in the spanning sheet.

Figure 6:
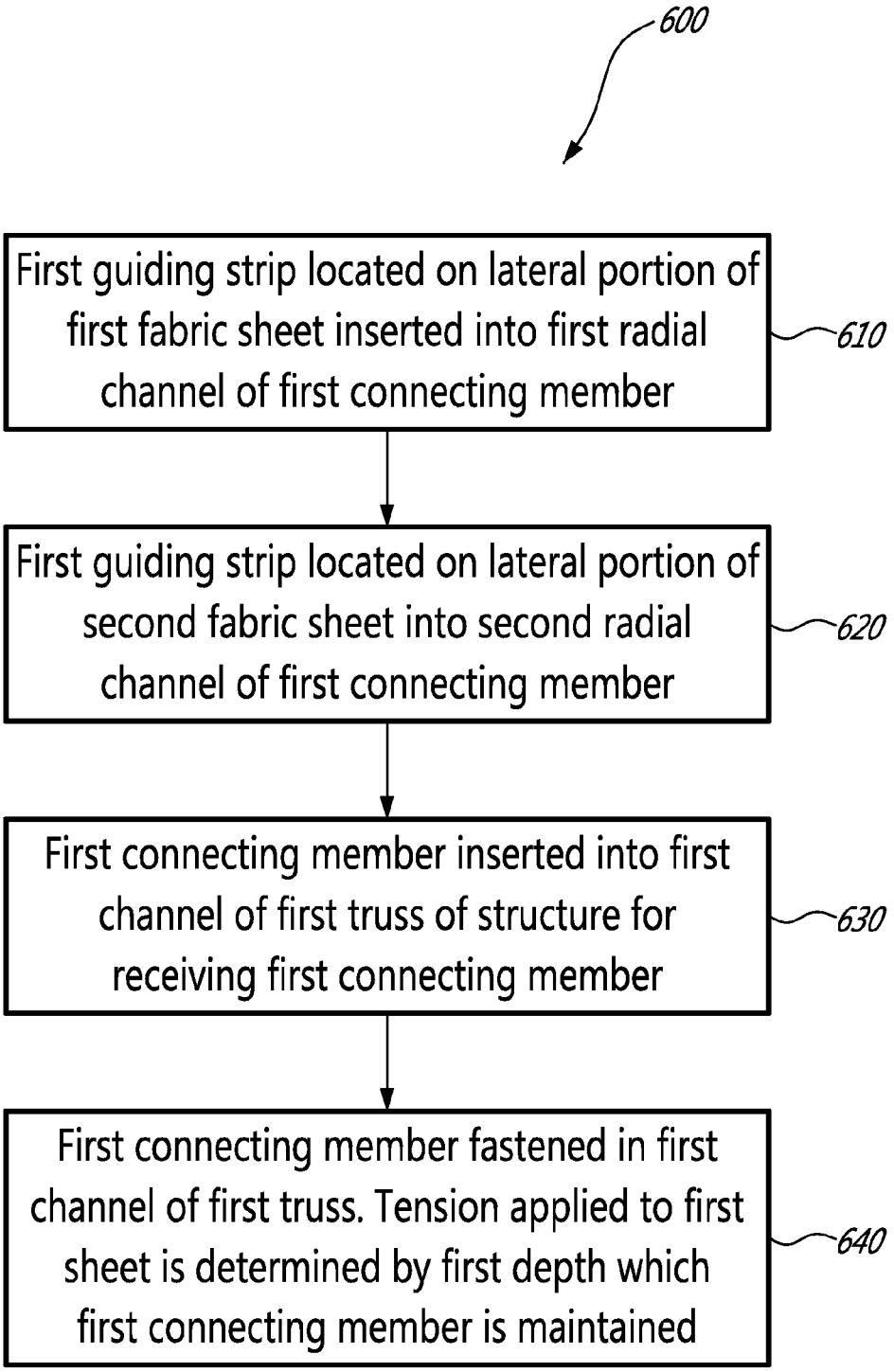
FIG. 6 is a flowchart of an exemplary method for installation of membrane sheets over a structure in accordance with the teachings of the present invention.

FIG. 6 shows an exemplary method 600 for installation of membrane on a structure. The exemplary method 600 comprises inserting a first guiding strip located on a lateral portion of a first membrane sheet into a radial channel of a first connecting member 610. A first guiding strip located on a lateral portion of a second membrane sheet is then inserted into a second radial channel of the first connecting member 620. The first connecting member is inserted into a first top channel of a first truss of the structure for receiving the first connecting member 630. The first connecting member is fastened in the first top channel of the first truss. Tension applied in the first sheet is related to a first depth at which the first connecting member is maintained in the first top channel 640. Exemplary cross-sectional views for installation of membrane over the structure 600 are shown in FIGS. 3, 4 and 5.

The method 600 for installation of membrane over the structure of FIG. 6 may further comprise inserting a second guiding strip located on an opposite portion of the first membrane sheet into a first radial channel of a second connecting member (not shown). The second connecting member may then be inserted into a second top channel of a second truss of the structure for receiving the second connecting member (not shown). The second connecting member may then be fastened in the second top channel of the second truss. The tension applied in the first sheet is related to both the first depth at which the first connecting member is maintained in the first top channel and a second depth at which the second connecting member is maintained in the second top channel of the second truss (not shown).

An exemplary embodiment of the method 600 for installation of membrane over the structure of FIG. 6 further comprises fastening the first connecting member to the first top channel of the first truss by bolting screws (not shown). Screw heads of the screws are received in a first bottom channel of the first connecting member (not shown). The screws are bolted into the first top channel of the first truss (not shown). A person ordinarily skilled in the art will readily recognize that the screws may be substituted by bolts (not shown) or other mechanism for fastening the connecting member to the truss without affecting the invention.

An exemplary embodiment of the method for installation of membrane over the structure 600 of FIG. 6 further comprises fastening the second connecting member to the second top channel of the second truss by bolting screws (not shown). Screw heads of the screws are received in a first bottom channel of the second connecting member (not shown). The screws are bolted into the second top channel of the second truss (not shown).

Figure 7:
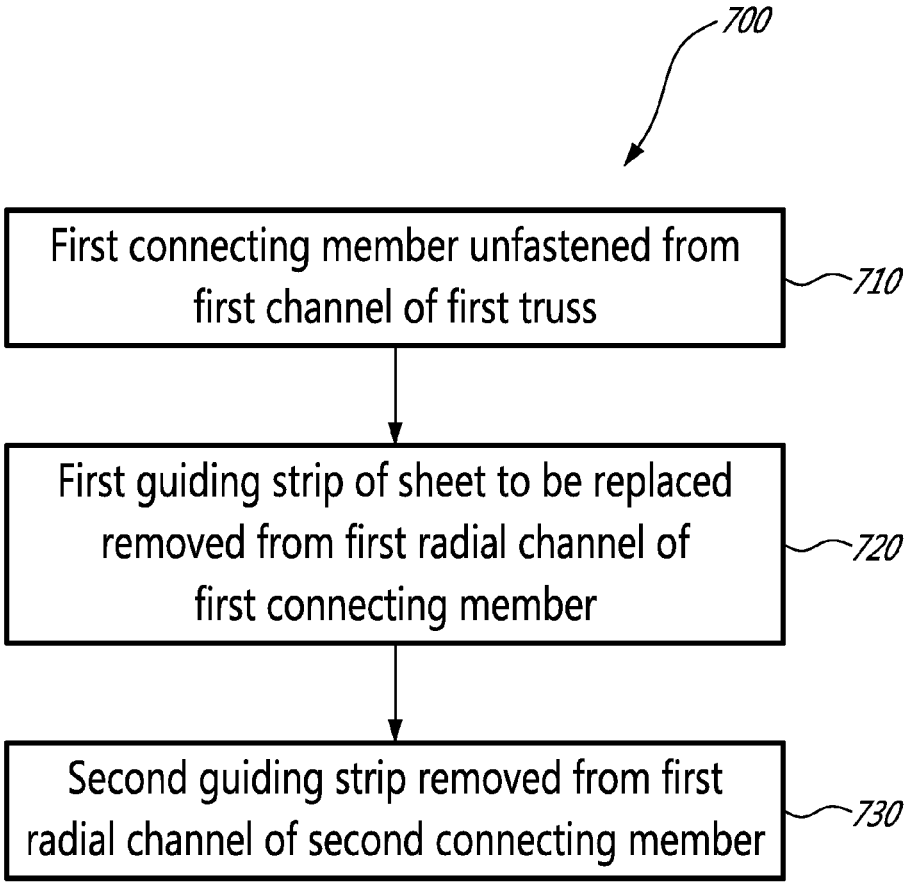
FIG. 7 is a flowchart of an exemplary method for replacing a membrane sheet to be replaced on a membrane covered structure in accordance with the teachings of the present invention.

FIG. 7 shows an exemplary method 700 for replacing a membrane sheet on a membrane covered structure. The membrane sheet to be replaced is under a first tension and inserted into a first connecting member fastened in a first top channel of a first truss. The membrane sheet to be replaced is also inserted into a second connecting member, which may be fastened in a second top channel of a second truss. The exemplary embodiment of the method for replacing the membrane sheet to be replaced on the membrane covered structure 700 of FIG. 7 comprises unfastening 710 the first connecting member from the first top channel of the first truss. The membrane sheet to be replaced has a first guiding strip, located on a lateral portion of the first sheet, the first guiding strip inserted into a first radial channel of the first connecting member. The first guiding strip of the sheet to be replaced is removed from the first radial channel of the first connecting member 720. A second guiding strip, located on an opposite lateral portion of the membrane sheet to be replaced, is removed from a first radial channel of the second connecting member 730.

In the exemplary embodiment of the method for replacing a membrane sheet to be replaced on the membrane covered structure 700 of FIG. 7, the unfastening may further comprise unbolting screws which are bolted into the first truss. Screw heads of the screws may be received in a first bottom channel of the first connecting member (not shown). A person ordinarily skilled in the art will readily recognize that the screws may be substituted by bolts (not shown) or other mechanism which are unfastened to loosen the connecting member form the truss without affecting the invention.

The exemplary embodiment of the method for replacing a membrane sheet on the membrane covered structure 700 of FIG. 7 may further comprise unfastening the second connecting member from the second top channel of the second truss (not shown). In the same exemplary embodiment of the method for replacing a membrane sheet to be replaced on the membrane covered structure 700 of FIG. 7, the unfastening may further comprise unbolting screws which are bolted into the second truss (not shown). Screw heads of the screws may be received in a second bottom channel of the second connecting member (not shown). In an exemplary embodiment of the method for replacing a membrane sheet to be replaced on the membrane covered structure 700 of FIG. 7, the screws may be substituted by bolts (not shown) or other mechanism which are unfastened to loosen the connecting member form the truss without affecting the invention.

The exemplary embodiment of the method for replacing a membrane sheet on the membrane covered structure 700 of FIG. 7 may further comprise inserting a first guiding strip located on a lateral portion of a replacing membrane sheet into the first radial channel of the first connecting member (not shown). A second guiding strip located on an opposite lateral portion of the replacing membrane sheet may further be inserted into the first radial channel of the second connecting member (not shown). In order to put the replacing sheet under control tension, the first connecting member is then fastened in the first top channel of the first truss. The tension applied in the replacing sheet is related to a depth at which the first connecting member is maintained in the first truss (not shown). The method for replacing a membrane sheet on the membrane covered structure 700 of FIG. 7 may further comprise fastening the second connecting member in the second top channel of the second truss (not shown). The tension applied in the replacing sheet would then be determined by the depth at which the first connecting member is maintained in the first top channel of the first truss and a depth at which the second connecting member is maintained in the second top channel of the second truss (not shown).

Exemplary embodiments have been described to demonstrate the use, principles, and function of the invention disclosed herein. These descriptions and illustrations are non-limiting exemplary embodiments and no limitation to the scope of the invention is thereby intended. Any alteration or modification to the device or alternative application of the invention principles are contemplated to normally occur by those with ordinary skill in the art to which the invention relates. Likewise, the description of the present invention has been presented for purposes of illustration but is not intended to be exhaustive or limited to the disclosed embodiments. Many modifications and variations will be apparent to those of ordinary skill in the art. The embodiments were chosen to explain the principles of the invention and its practical applications and to enable others of ordinary skill in the art to understand the invention in order to implement various embodiments.

What is claimed is:

1. A system for retaining a membrane on a structure comprising:

(a) a rigid connecting member comprising at least one radial channel for receiving a first guiding strip of a first membrane sheet having the first guiding strip and a second guiding strip;

(b) a truss of the structure; and (c) a fastening mechanism for adjusting tension in the first membrane sheet by controlling depth at which the rigid connecting member is maintained within a top channel on the truss, wherein tension is adjusted by adjusting spacing between the rigid connecting member and the top channel, the first membrane sheet being maintained between the top channel and the rigid connecting member;

(d) whereby the at least one radial channel is capable of capturing the first guiding strip prior to the application of tension by the fastening mechanism.

2. The system for retaining membrane over the structure of claim 1, wherein the first membrane sheet is in contact with the top channel and the rigid connecting member, the connecting member being laterally stabilized in the top channel.

3. The system for retaining membrane over the structure of claim 1, wherein the tension in the first membrane outside of the top channel, once adjusted, is on a tension axis that is not parallel to a radial axis defined between the center of the first guiding strip and an opening of the radial channel.

4. The system for retaining membrane over the structure of claim 1, wherein the first guiding strip of the first sheet is located on a lateral portion of the first sheet and wherein the second guiding strip of the first sheet is located on an opposite lateral portion of the first sheet.

5. The system for retaining membrane over the structure of claim 1, wherein the top channel is formed by an upper surface of the truss or wherein the top channel is maintained over an upper surface of the truss.

6. The system for retaining membrane over the structure of claim 1, wherein the sheet is made of fabric.

7. The system for retaining membrane over the structure of claim 1, wherein the rigid connecting member comprises multiple sub-connecting members within the top channel on the truss.

8. The system for retaining membrane over the structure of claim 1, wherein the rigid connecting member comprises a second radial channel, wherein a first guiding strip of a second sheet of membrane is inserted in the second radial channel.

9. The system for retaining membrane over the of claim 1, wherein the rigid connecting member is extruded and wherein the rigid connecting member is made of aluminum, an aluminum alloy or a polymer.

10. The system for retaining membrane over the structure of claim 1, wherein the rigid connecting member comprises a bottom channel and the fastening mechanism comprises screws and nuts, wherein the bottom channel is adapted to receive screw heads of the screws, and wherein the screws are bolted into the top channel on the truss, the tension being adjusted by applying a torque to the bolted screws maintaining the rigid connecting member into the top channel.

11. The system for retaining membrane on a structure of claim 1, wherein the guiding strips are flexible.

12. The system for retaining membrane over the structure of claim 1, wherein the truss is made of steel or galvanized steel.

13. A method for installation of membrane sheets over a structure, comprising:

(a) inserting a first guiding strip located on a lateral portion of a first membrane sheet into a first radial channel of a first rigid connecting member, whereby the first radial channel captures the first guiding strip prior to the application of tension;

(b) inserting the first rigid connecting member into a first top channel of a first truss of the structure for receiving the first rigid connecting member; and (c) fastening the first rigid connecting member in the first top channel of the first truss, wherein tension applied in the first sheet is related to a first depth at which the first rigid connecting member is maintained in the first top channel of the first truss, wherein tension is adjusted by adjusting spacing between the rigid connecting member and the first top channel the first membrane sheet being maintained between the top channel and the rigid connecting member.

14. The method for installation of membrane sections over the structure of claim 13, wherein the first membrane sheet is in contact with the first top channel and the first rigid connecting member, the first rigid connecting member being laterally stabilized in the first top channel.

15. The method for installation of membrane sections over the structure of claim 13, wherein the tension in the first membrane, once applied, is on a tension axis that is not parallel to a radial axis between the center of the first guiding strip and an opening of the first radial channel.

16. The method for installation of membrane sheets over the structure of claim 13, further comprising:

(a1) after (a), inserting a first guiding strip located on a lateral portion of a second membrane sheet into a second radial channel of the first rigid connecting member.

17. The method for installation of membrane sheets over the structure of claim 16, further comprising:

(d) inserting a second guiding strip located on an opposite lateral portion of the first membrane sheet into a first radial channel of a second rigid connecting member;

(e) inserting the second rigid connecting member into a second top channel of a second truss of the structure for receiving the second rigid connecting member; and (f) fastening the second rigid connecting member in the second top channel of the second truss, wherein the tension applied in the first sheet is related to both the first depth at which the first rigid connecting member is maintained in the first top channel of the first truss and a second depth at which the second rigid connecting member is maintained in the second top channel of the second truss.

18. The method for installation of membrane sections over the structure of claim 17, further comprising fastening the second rigid connecting member to the second top channel of the second truss by bolting screws, wherein screw heads of the screws are received in a second bottom channel of the second rigid connecting member and wherein the screws are bolted into the second top channel of the second truss.

19. The method for installation of membrane sections over the structure of claim 17, further comprising:

fastening the first rigid connecting member to the first top channel of the first truss by bolting first screws, wherein screw heads of the first screws are received in a first bottom channel of the first connecting member and wherein the first screws are bolted into the first top channel of the first truss; and fastening the second rigid connecting member to the second top channel of the second truss by bolting second screws, wherein screw heads of the second screws are received in a second bottom channel of the second rigid connecting member and wherein the second screws are bolted into the second top channel of the second truss.

20. The method for installation of membrane sections over the structure of claim 13, further comprising fastening the first rigid connecting member to the first top channel of the first truss by bolting screws, wherein screw heads of the screws are received in a first bottom channel of the first rigid connecting member and wherein the screws are bolted into the first top channel of the first truss.

21. A method for removing a membrane sheet to be replaced on a membrane covered structure, wherein the membrane sheet to be replaced is under a first tension and inserted into a first rigid connecting member fastened in a first top channel of a first truss and a second rigid connecting member fastened to a second truss, the method comprising:

(a) unfastening, at least partially, the first rigid connecting member from the first top channel of the first truss, wherein the membrane sheet to be replaced has a first guiding strip, located on a lateral portion of the first sheet, the first guiding strip inserted into a first radial channel of the first rigid connecting member, wherein tension is adjusted by adjusting spacing between the rigid connecting member and the first top channel, the first radial channel capturing the first guiding strip prior to the application of tension, wherein the membrane sheet is maintained between the first top channel and the first rigid connecting member when the first rigid connecting member is fastened in the first top channel;

(b) removing the first guiding strip of the sheet to be replaced from the first radial channel of the first rigid connecting member; and (c) removing a second guiding strip, located on an opposite lateral portion of the membrane sheet to be replaced, from a first radial channel of the second rigid connecting member.

22. The method for removing the membrane sheet to be replaced of the membrane covered structure of claim 21, wherein the unfastening further comprises unbolting screws which are bolted into the first truss and wherein screw heads of the screws are received in a first bottom channel of the first rigid connecting member.

23. The method for removing the membrane sheet to be replaced of the membrane covered structure of claim 21, further comprising unfastening the second rigid connecting member from a second top channel of the second truss.

24. The method for removing the membrane sheet to be replaced of the membrane covered structure of claim 21, wherein the unfastening further comprises unbolting screws which are bolted into the second truss and wherein screw heads of the screws are received in a second bottom channel of the second rigid connecting member.

25. The method for removing the membrane sheet to be replaced of the membrane covered structure claim 21, further comprising:

(d) inserting a first guiding strip located on a lateral portion of a replacing membrane sheet into the first radial channel of the first rigid connecting member;

(e) inserting a second guiding strip located on an opposite lateral portion of the replacing membrane sheet into the first radial channel of the second rigid connecting member; and (f) fastening the first rigid connecting member in the first top channel of the first truss, wherein a second tension applied in the replacing sheet is determined by a depth at which the first rigid connecting member is maintained in the first top channel of the first truss.

26. The method for removing the membrane sheet to be replaced of the membrane covered structure claim 21, further comprising:

(d) inserting a first guiding strip located on a lateral portion of a replacing membrane sheet into the first radial channel of the first rigid connecting member;

(e) inserting a second guiding strip located on an opposite lateral portion of the replacing membrane sheet into the first radial channel of the second rigid connecting member;

(f) fastening the first rigid connecting member in the first top channel of the first truss;

(g) fastening the second rigid connecting member in the second top channel of the second truss, wherein a second tension applied in the replacing sheet is determined by a depth at which the first rigid connecting member is maintained in the first top channel of the first truss and a depth at which the second rigid connecting member is maintained in the second top channel of the second truss.

27. The method for removing the membrane sheet to be replaced of the membrane covered structure of claim 26, wherein the second tension applied in the replacing sheet is determined by a depth at which the first rigid connecting member is maintained in the first top channel of the first truss and the depth at which the second rigid connecting member is maintained in the second top channel of the second truss.

* * * * *